US006640716B1

(12) United States Patent
Alonso et al.

(10) Patent No.: US 6,640,716 B1
(45) Date of Patent: Nov. 4, 2003

(54) IMAGING PRINT MEDIA

(75) Inventors: Xavier Alonso, Barcelona (ES); Elisa Serra, Cassà de la Selva Girona (ES); Llorenç Vallès, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/207,181

(22) Filed: Jul. 30, 2002

(51) Int. Cl.[7] ..... B41F 1/54

(52) U.S. Cl. ..... 101/484; 101/228; 382/107; 250/548; 250/559.2; 250/559.04; 250/559.08

(58) Field of Search ..... 101/484, 211, 101/225, 228, DIG. 36, 485; 382/106, 107, 210, 270; 347/19; 700/259; 250/548, 559.11, 559.2, 559.01, 559.04, 559.05, 559.06, 559.08

(56) References Cited

U.S. PATENT DOCUMENTS 4,017,721 A * 4/1977 Michaud ..... 700/259
5,633,676 A * 5/1997 Harley et al. ..... 101/DIG. 36
5,633,719 A * 5/1997 Oehlbeck et al. ..... 250/548
5,940,537 A * 8/1999 Regen et al. ..... 382/210
5,943,448 A * 8/1999 Tatsuta ..... 382/270
5,990,468 A * 11/1999 Cornuejols ..... 250/559.05
6,022,154 A * 2/2000 Allen ..... 101/248
6,024,018 A * 2/2000 Darel et al. ..... 101/484
6,026,172 A * 2/2000 Lewis, Jr. et al. ..... 382/106
6,517,180 B2 * 2/2003 Tullis et al. ..... 347/19
2002/0178952 A1 * 12/2002 Sainio et al. ..... 101/485

* cited by examiner

*Primary Examiner*—Eugene H. Eickholt
(74) *Attorney, Agent, or Firm*—Lee & Hayes, PLLC

(57) ABSTRACT

A method and apparatus for imaging material. A section of a medium is photographed with a first camera having a first field of view. The medium is advanced along a feed direction and the section is photographed with a second camera having a second field of view. At least one of the first field of view and the second field of view is shifted from a nominal location by one or more reflective surfaces. An actual advance of the medium is compared with an intended advance of the medium and it is determined whether at least one of a media advance error and a dimensional change in the media exists in response to the comparing step.

40 Claims, 5 Drawing Sheets

IMAGING PRINT MEDIA

TECHNICAL FIELD

The present invention relates generally to imaging print media.

BACKGROUND ART

It is generally known that errors may occur as media is fed through an image forming apparatus during printing operations. The errors may occur in the scan and media feed directions and may affect dot placement upon the media. It is also generally known that the media may expand or contract with changes in the moisture content of the media. In one respect, media expansion may occur because print media is typically composed, at least in part, of cellulose or some other absorbent material which often expands as it absorbs water. Therefore, as ink is sprayed or fired onto the media, the media may absorb the ink and expand. One problem associated with feed errors and media expansion or contraction is that placement of subsequently applied ink drops may not reach their intended targets. This may result in poor print quality, as the ink drops may not be arranged on the media as intended.

In some printing processes, such as with laser printers, the media may be heated, which may result in evaporation of some moisture from the media, thus causing the media to contract. This may result in media movement within the printing apparatus. Such movement may ultimately result in printing errors, and improper advancement of the media through the printing apparatus. Again, print media movement may deteriorate the quality of the image produced, and in some cases, may render the image produced entirely unacceptable.

It is often possible to measure media feed as well as media expansion/contraction (e.g., dimensional change in the media) errors. One manner involves the use of relatively sophisticated cameras having relatively high degrees of accuracy. These cameras typically have limited fields of vision. For instance, the size of an object that may be captured within a single picture may be relatively limited. According to this manner, a pair of cameras is typically placed along a media feed direction at a predetermined distance from each other. However, when the media feed distance to be measured is small (e.g., on the order of ⅛ of an inch or smaller), it is not possible to measure with sufficient accuracy, any feed errors between consecutive media feed operations due to the physical limitations of these types of cameras.

SUMMARY

According to an embodiment, the invention pertains to a method of imaging material. In the method, a section of a medium is photographed with a first camera having a first field of view. The medium is advanced along a feed direction and the section is photographed with a second camera having a second field of view. At least one of the first field of view and the second field of view is shifted from a nominal location by one or more reflective surfaces. An actual advance of the medium is compared with an intended advance of the medium and it is determined whether at least one of a media advance error and a dimensional change in the media exists in response to the comparing step.

In another embodiment, the invention relates to a system for imaging print media configured to advance along a feed direction. The system includes a first camera assembly including a first camera having a first field of view and at least one reflecting surface configured to shift the first field of view from a nominal location and a second camera assembly having a second camera. The system also includes a computer configured to receive images photographed by the first camera and the second camera. The computer is also configured to determine a vector indicating a distance traveled by an section of the print media photographed by the first camera and the second camera.

In accordance with a further embodiment, the invention relates to an apparatus for determining errors during printing operations of a printing device having a media feed direction. The apparatus includes a first camera assembly having a camera with a first field of view and at least one reflective surface to deflect the first field of view from a nominal location. The apparatus also includes a second camera assembly having a camera with a second field of view. The first camera and the second camera are configured to photograph a section of media contained in the printing device. In addition, the second camera assembly is positioned at a location substantially downstream of the first camera assembly along the media feed direction of the printing device.

According to a yet further embodiment, the invention pertains to an apparatus for imaging print media. The apparatus includes first means for photographing a section of the print media having a first field of view. The apparatus also includes second means for photographing the section of the print media having a second field of view. In addition, the apparatus includes means for deflecting the first field of view from a nominal location toward the second field of view and means for determining whether at least one of a media advance error and a dimensional change in the media exists.

BRIEF DESCRIPTION OF THE DRAWINGS

Features and aspects of the present invention will become apparent to those skilled in the art from the following description with reference to the drawings, in which.

DETAILED DESCRIPTION

For simplicity and illustrative purposes, the principles of the present invention are described by referring mainly to various embodiments thereof. In the following description, numerous specific details are set forth in order to provide a thorough understanding of the present invention. It will be apparent however, to one of ordinary skill in the art, that the present invention may be practiced without limitation to these specific details. In other instances, well known methods and structure have not been described in detail so as not to unnecessarily obscure the present invention. The terminology used herein is for the purpose of description and not of limitation.

Figure 1:
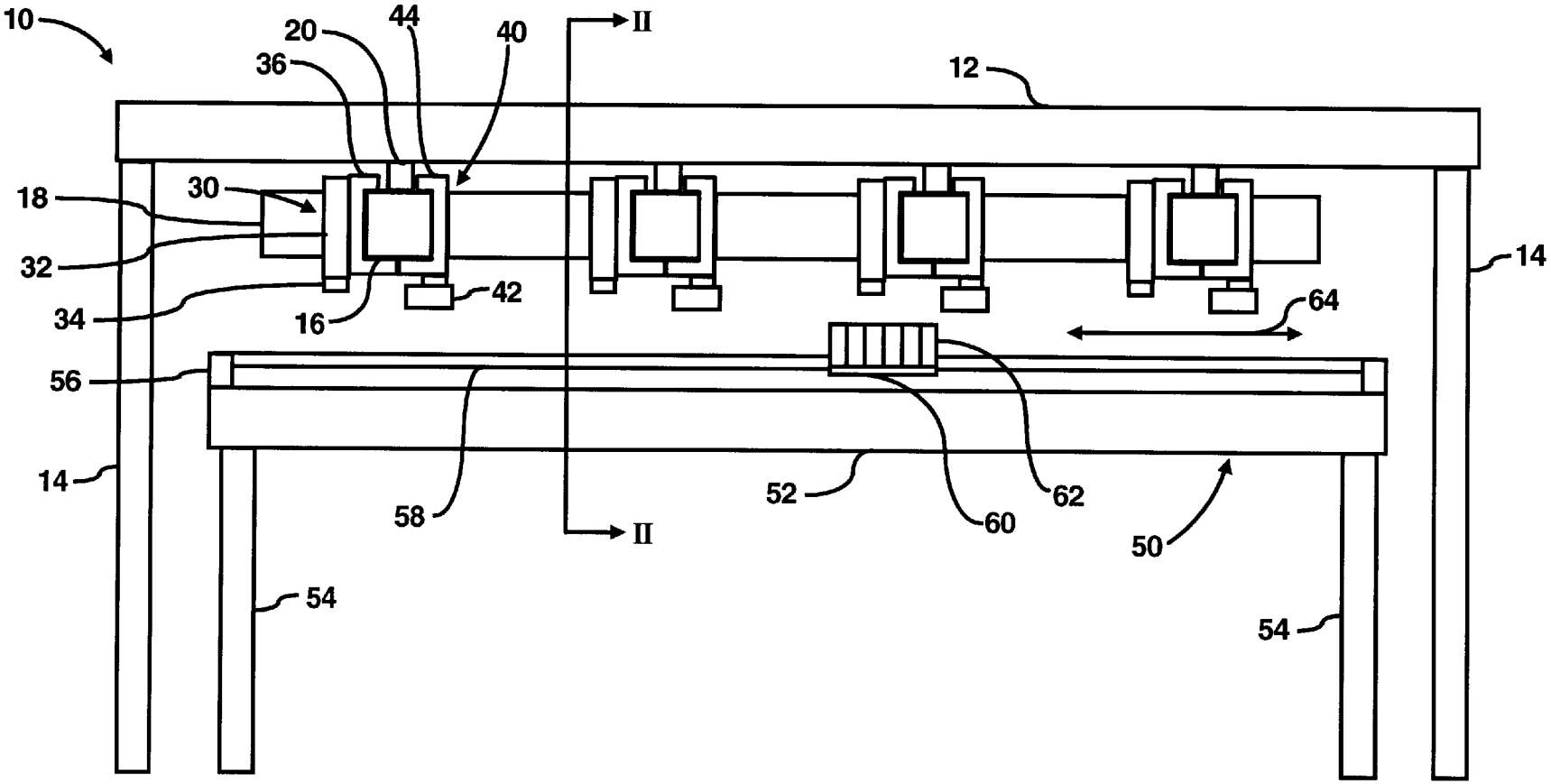
FIG. 1 shows a simplified front view of a device according to an embodiment of the invention.

Referring to FIG. 1, there is shown a simplified illustration of a device 10 for relatively high-resolution photography. The device 10 includes a member 12 supported by a plurality of legs 14. Attached to a bottom side of the member 12 are a plurality of mounting plates 16 (only one of the plates 16 is labeled) and a track 18. The mounting plates 16 and the track 18 may comprise relatively solid beams capable of supporting various camera related and light related components without substantial deflection. In this respect, the mounting plates 16 and the track 18 may be composed of metal (e.g., aluminum, steel, etc.), plastic, or other suitable materials. The mounting plates 16 and the track 18 may be attached to the member 12 in any reasonably suitable manner (e.g., threaded fasteners, welding, adhesive, and the like). In FIG. 1, a plurality of supports 20 are depicted as providing a gap and supporting the mounting plates 16 and the track 18.

The mounting plates 16 are each illustrated as supporting respective camera assemblies 30 and optional light assemblies 40 for illuminating the media (only one camera assembly 30 and light assembly 40 are labeled). The light assemblies 40 may be considered as being optional because their use may not be required in certain instances, as for example, when sufficient light is available for the camera assemblies 30 to operate. Although not illustrated in FIG. 1, the mounting plates 16 may each be configured to support two or more camera assemblies 30. This configuration is described in greater detail hereinbelow. Additionally, although four mounting plates 16 and four camera assemblies 30 are illustrated in FIG. 1, it should be understood that any reasonably suitable number of mounting plates 16 and camera assemblies 30 may be implemented in the present embodiment of the invention without departing from the scope of the invention. It should also be understood that the device 10 may comprise mounting plates 16 that support no camera assemblies 30.

The camera assemblies 30 include cameras 32 having reflecting surfaces 34 located at a location when light enters into the cameras 32. The cameras 32 may comprise a relatively high resolution camera, e.g., cameras capable of photographing objects to within about five microns ($5\times10^{-6}$). The cameras 32 are attached to connectors 36 that may be mounted on the mounting plate 16 in a slidable manner. That is, the connectors 36 may be configured to travel along the length of the mounting plate 16. This configuration, therefore, generally enables the cameras 32, along with the reflecting surfaces 34 to travel along the length of the mounting plate 16. The camera 32 may be attached to the connector 36 with a bracket assembly, adhesive, welding, and other reasonably suitable manners. Moreover, cameras 32 may be film, digital or combination thereof.

The light assemblies 40 may be attached to the mounting plates 16 in manners similar to those described above with respect to the camera assemblies 30. More specifically, a light source 42 may be attached to a connector 44 that is configured to slidably travel along the mounting plate 16. Alternatively, the connector 44 may be substantially fixedly attached to the mounting plate 16 with the light source 42 spanning a substantial distance along the length of the mounting plate 16. In any event, the light source 42 is designed to relatively enhance the photographic images taken by the camera 32.

It should be readily apparent to those of ordinary skill in the art that the device 10 depicted in FIG. 1 represents a generalized illustration and that other components may be added or existing components may be removed or modified without departing from the scope of the present invention. For example, the device 10 may be supported from a ceiling or a wall of a structure or otherwise be suspended off the ground.

Also illustrated in FIG. 1 is a printing apparatus 50, in this instance a large format inkjet printer. The printing apparatus 50 includes a substantially horizontal portion 52 supported by legs 54. The substantially horizontal portion 52 generally provides a surface upon which a printing material may be applied to a medium (not shown). Illustrated on an upper surface of the printing apparatus 50 are a pair of protrusions 56 supporting a rod 58. A carriage 60 is attached to the rod 58 in a manner that generally enables the carriage to travel along a substantial length of the rod 58. The carriage 60 may include a plurality of pens 62 for applying the printing material onto the medium. In operation, the carriage 60 generally travels in one or more of the directions indicated by arrow 64 while delivering printing material to create images on the medium.

It should be readily apparent to those of ordinary skill in the art that the printing apparatus 50 depicted in FIG. 1 represents a generalized illustration and that other components may be added or existing components may be removed or modified without departing from the scope of the present invention. For example, the printing device 50 may include components for moving the carriage 60 and firing the pens 62 (e.g., motor, encoder, cables, and the like).

As can be seen in FIG. 1, the device 10 is positioned to enable the carriage 60 along with the pens 62 to travel beneath the camera assemblies 30. In this respect, as the pens 62 apply printing material onto the medium, the cameras 32 may photograph the applied printed material.

Figure 2:
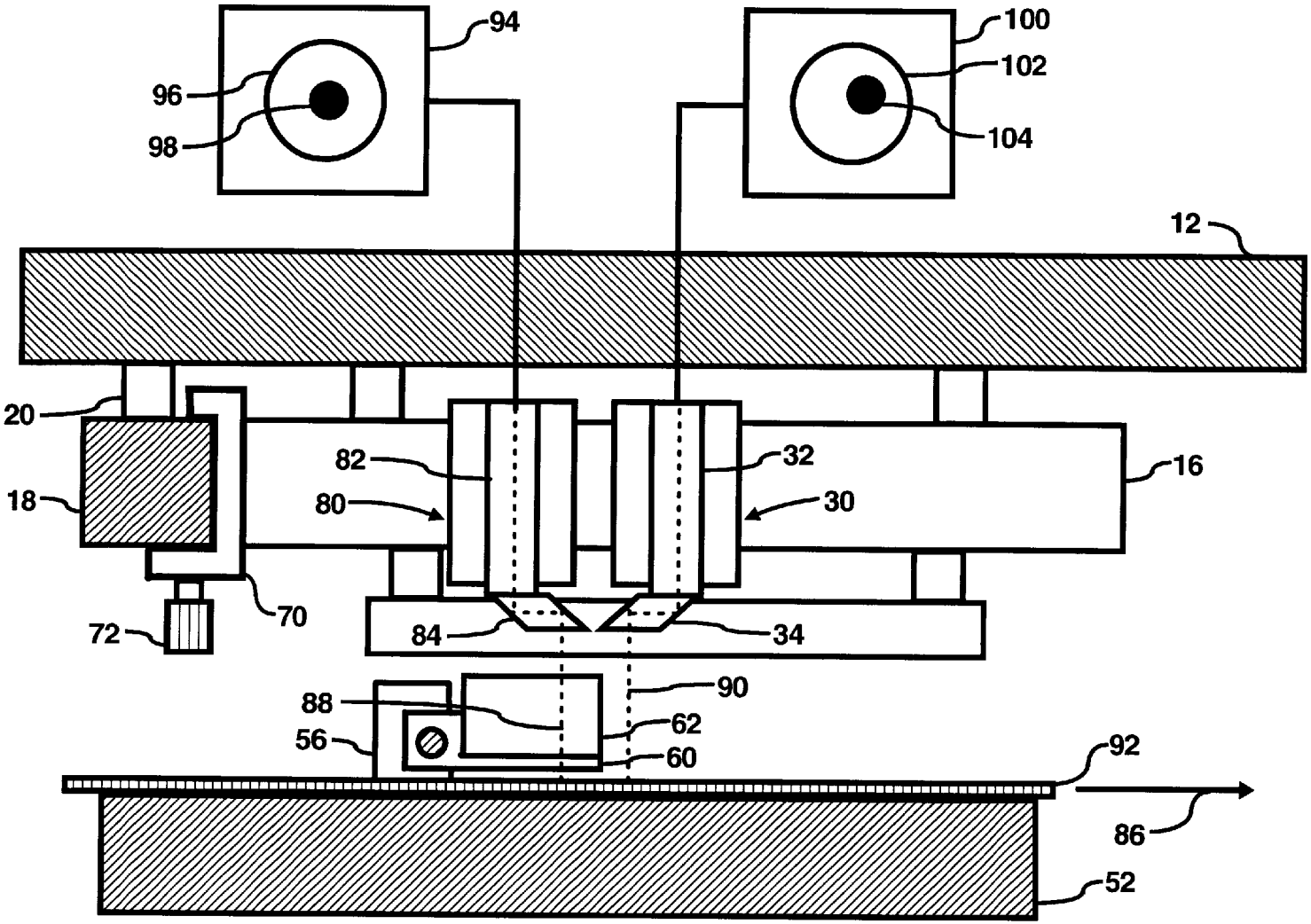
FIG. 2 shows an enlarged cross-sectional side view along lines II—II in FIG. 1.

With reference now to FIG. 2, there is illustrated an enlarged cross-sectional side view along lines II—II in FIG. 1. As seen in FIG. 2, the mounting plate 16 is attached to the track 18 through a connector 70. The mounting plate 16 may be attached to the connector 70 through, for example, welding, mechanical fasteners, adhesives, and like reasonably suitable attachments. The connector 70 may engage the track 18 in a manner to enable the connector 70 to travel along the length of the track 18. The connector 70 may be positioned in a relatively fixed location with respect to the track 18 through use of a mechanical fastener 72. The mechanical fastener 72 may comprise a threaded end with a knob located at an opposite end of the fastener 72. Thus, the mounting plate 16, and hence the camera assemblies 30 may be positioned at various locations along the scan axis 64 (FIG. 1). Referring back to FIG. 1, although not specifically illustrated, the connectors 36 and 44 may also include mechanical fasteners 72 to maintain the camera assemblies 30 in relatively secure manners while enabling them to be positioned at various locations along the mounting plates 16.

One or more of the connectors 35, 44, and 70 may include motorized mechanisms (not shown) to enable them to be moved to various locations along one of the track 18 and the mounting plates 16. Such mechanisms would include the necessary hardware and/or software components as are commonly known in the art of motorized devices.

Also illustrated in FIG. 2 are a pair of camera assemblies 30 and 80. Each of the camera assemblies 30 and 80 is connected to the mounting plate 16 in a manner described hereinabove with respect to FIG. 1. A first camera assembly 80 includes a camera 82 and a plurality of reflective surfaces 84. A second camera assembly 30 includes a camera 32 and a plurality of reflective surfaces 34. The plurality of reflective surfaces 84 and 34 may be attached to respective cameras 82 and 32 with any reasonably suitable fastening devices, e.g., brackets, threaded fasteners, and the like. The plurality of reflective surfaces 84 and 34 may be housed within a casing and may comprise any reasonably suitable reflective surfaces. By way of example, the reflective surfaces 84 and 34 may comprise mirrors, prisms, and like reflective surfaces.

The first camera assembly 80 and the second camera assembly 30 may be configured to travel along the mounting plate 16 in a direction generally indicated by arrow 86, which also indicates the media feed direction. In this respect, the distance between the first and second cameras 80 and 30 may be varied.

The dotted lines 88 and 90 generally refer to the respective manners in which light from, for example, the medium 92 may enter into the cameras 82 and 32. More particularly, the first camera 82 includes a field of view that is shifted relative to the nominal field of view by virtue of the reflective surfaces 84. In addition, the second camera 32 includes a field of view that is shifted relative to the nominal field of view by virtue of the reflective surfaces 34. The nominal fields of view of the first camera 82 and the second camera 30 constitute those respective fields of view the cameras would have if they were not deflected by the reflective surfaces 84 and 34.

The field of view of the first camera 82 may generally be aligned with a section of a print zone of the pens 62. Thus, the first camera 82 may photograph images substantially immediately after they are printed onto the medium 92. The field of view of the second camera 32 corresponds to a location generally downstream along the media feed direction, indicated by arrow 86. The field of view location of the second camera 32 may be varied with respect to the field of view location of the first camera 82 as described above.

The reflective surfaces 84 and 34 generally enable the fields of view of the first and second cameras 82, 32 to be relatively closer to one another than would physically be possible without use of the reflective surfaces 84 and 34. More specifically, the reflective surfaces 84 and 34 are designed to shift the fields of view of the cameras 82 and 32 toward one another. Therefore, the second camera 82 may be capable of photographing a printed image when the media 92 is fed a distance that is substantially less than a full swath height. By way of example, in the event that the printing process is configured in a four (4) pass print mode, e.g., the cartridge 60 performs four passes to print a swath, the second camera 32 may photograph a printed image when the media 92 has been fed one-quarter of a swath height.

In addition, by virtue of the second camera assembly's 30 movability along the mounting plate 16, the second camera 32 may photograph a printed image when the media 92 has been advanced any reasonable distance, such as, a selected fraction of a swath or one or more swath heights.

Although FIG. 2 illustrates both camera assemblies 80 and 30 as including reflective surfaces 84 and 34, respectively, it should be understood that both reflective surfaces may not be needed to implement embodiments of the present invention. By way of example, the second camera assembly 80 may not include reflective surface 84.

The cameras 82 and 32 may be any reasonably suitable type of camera capable of generating a electrical representation of a visual image. In this regard, the cameras 82 and 32 may comprise digital cameras, analog cameras, and the like. The cameras 82 and 32 are configured to photograph printed images applied onto the print medium 92. More particularly, the cameras 82 and 32 may photograph the same image sequentially, i.e., one image may be photographed by the first camera 82, the media may be advanced a predetermined distance, and photographed by the second camera 32.

The first camera 82 may send photographic images to a computer (not shown) which may display the images on a screen 94. An image of the field of view 96 along with an image of a printed material 98 may be viewed on the screen 94. In a likewise manner, an image of the field of view 102 along with an image of a printed material 104 may be seen on a screen 100. It should be understood that the photographic images need not be displayed on either screen 94 or 104 and that if a screen is implemented, that both fields of view along with their images may be displayed on the same screen, e.g., screen 94 or 104.

Figure 3A:
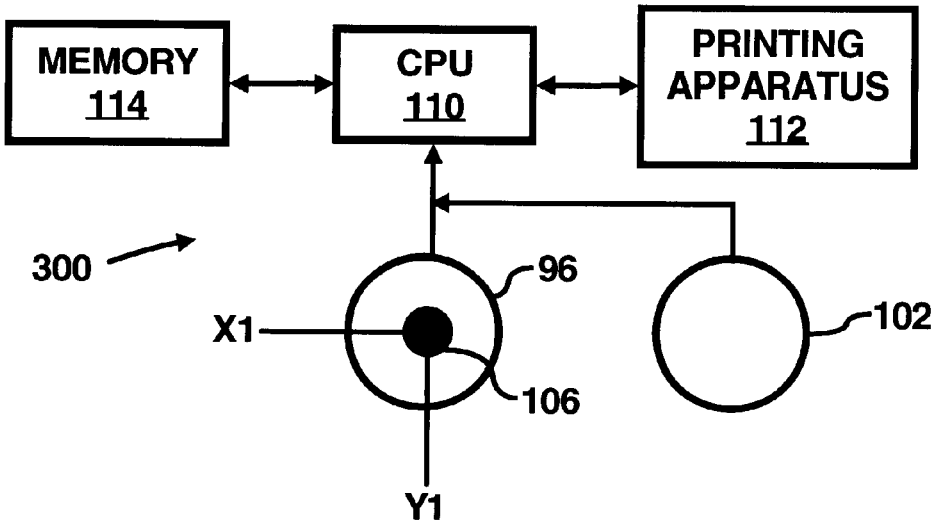
FIGS. 3A–3B, collectively, illustrate a manner of implementing the device of FIG. 1 according to a first embodiment of the invention.

In FIG. 3A, there is illustrated a block diagram of a control scheme 300 of the device 10 depicted in FIG. 1. Shown in FIG. 3A are an image comprising the field of view 96 and printed element 106 photographed by the first camera 82, as may be displayed for example on the screen 94. Also illustrated is the field of view 102 of the second camera 30. Illustrated in FIG. 3A is a depiction of a photographic image taken by the first camera 82. The photographed image may be sent to a central processing unit (CPU) 10 which may determine a centroid of the printed element 106 relative to the field of view of a camera, where the centroid determination may be implemented by a software program. The CPU 10 may denote the centroid's location in two dimensions as x1 and y1 relative to the field of view of the camera.

Also illustrated in FIG. 3A is a printing apparatus 112. The CPU 110 may control the printing apparatus 112 by forwarding instructions thereto. By way of example, the CPU 110 may instruct the printing apparatus 1 12 to perform another printing pass upon photographing of the printed element 106 by the first camera 82. In addition, the CPU 112 may instruct the first camera 82 to photograph the printed element 106 once the printed element 106 has been applied onto the medium 92.

Figure 3B:
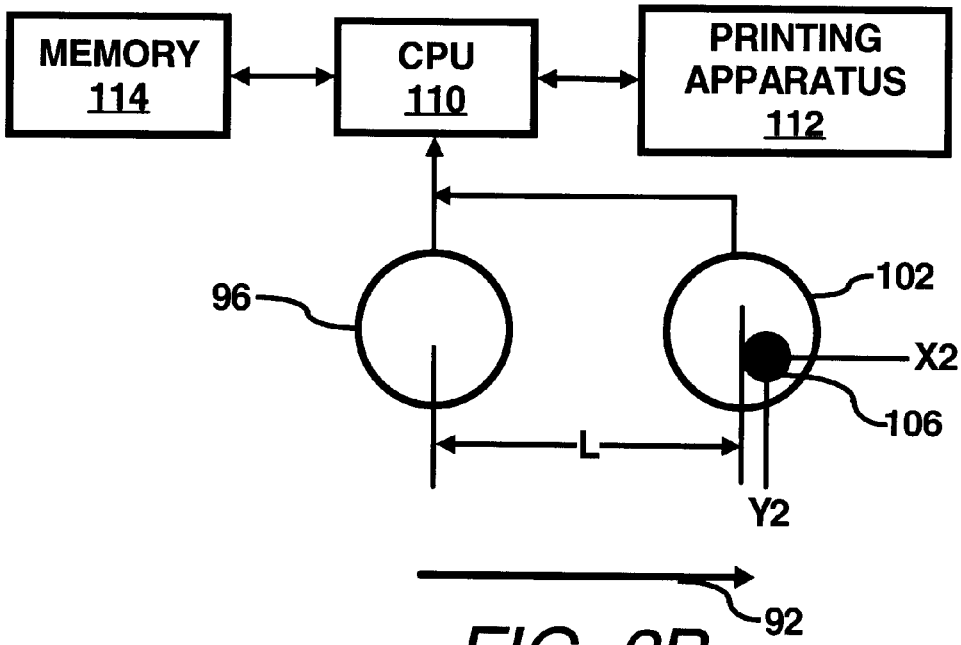

Referring now to FIG. 3B, the printed element 106 is illustrated as being located within the field of view 102 of the second camera 32. The printed element 106 may enter the field of view 102 through a feeding operation of the media 92 of a desired length denoted by "L". As described above, the distance L generally equates to a media feed length set according to a selected print mode, e.g., a multi-pass print mode. Therefore, for example, L may be equivalent to some fraction or more of a swath height. The image of the printed element 106 may be photographed by the second camera 32 and the image forwarded to the CPU 110. The CPU 110 may then determine the centroid of the printed element 106 in two dimensions relative to the second camera's 32 field of view, which may be denoted as x2 and y2.

The CPU 110 generally includes a memory 114 configured to store the centroid locations of the photographed images. The memory 114 may also store a program configured to determine the actual advance of the media. The algorithm may be designed to compare a desired advance of the media with the measured advance of the media and may be implemented by the CPU 110. The desired advance may be denoted as L, as previously described. The measured advance of the media may be determined through calculation of a vector, using the formula (x2, y2)–(x1, y1), which equates to a vector of real media advance.

If there are no media advance errors, the print medium is determined to have advanced in the y-direction only a distance of L. However, if media advance errors exist, those errors may be represented by the formula (x2–x1, y2–y1–L). The magnitude and direction of the media advance errors may be determined through analysis of the vector formed through application of this formula. If the CPU 110 determines that media advance errors exist, the CPU 10 may return an indication that such errors exists, for example, through a display, an alarm, etc.

Through use of a plurality of pairs of cameras arranged at different locations along the scan axis (illustrated in FIG. 1), the resolution of the media advance errors may be increased. More specifically, the greater the number of camera pairs implemented to determine the media advance errors, the greater the resolution of the errors. Thus, a more accurate determination of the manner and magnitude of media advance errors occurring within a printing apparatus may be made.

In addition, the manner and magnitude of media advance errors may be further accurately determined through the use of a print medium 92 comprised of a glossy material that is substantially resistant to expansion and/or contraction due to moisture absorption and/or evaporation. In this respect, errors due to media expansion/contraction may be substantially reduced to generally isolate errors in media advancement.

Figure 4A:
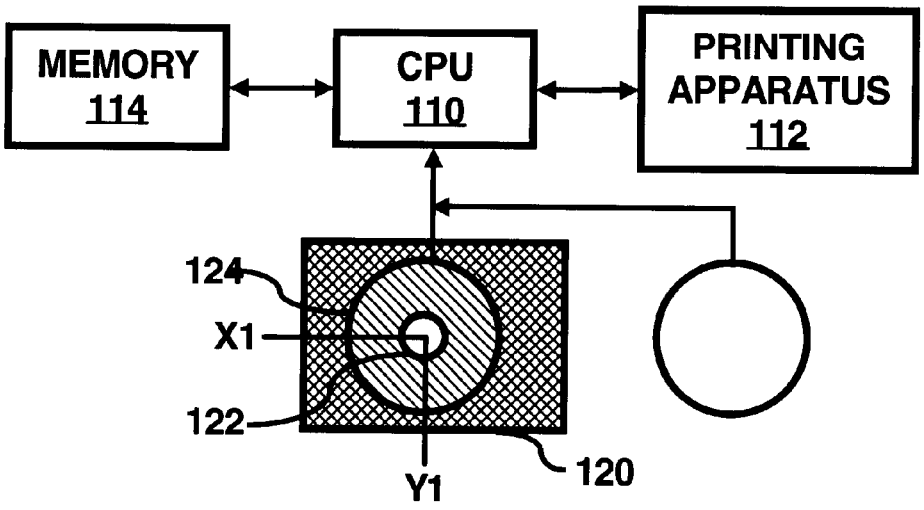
FIGS. 4A–4B, collectively, illustrate another manner of implementing the device of FIG. 1.
Figure 4B:
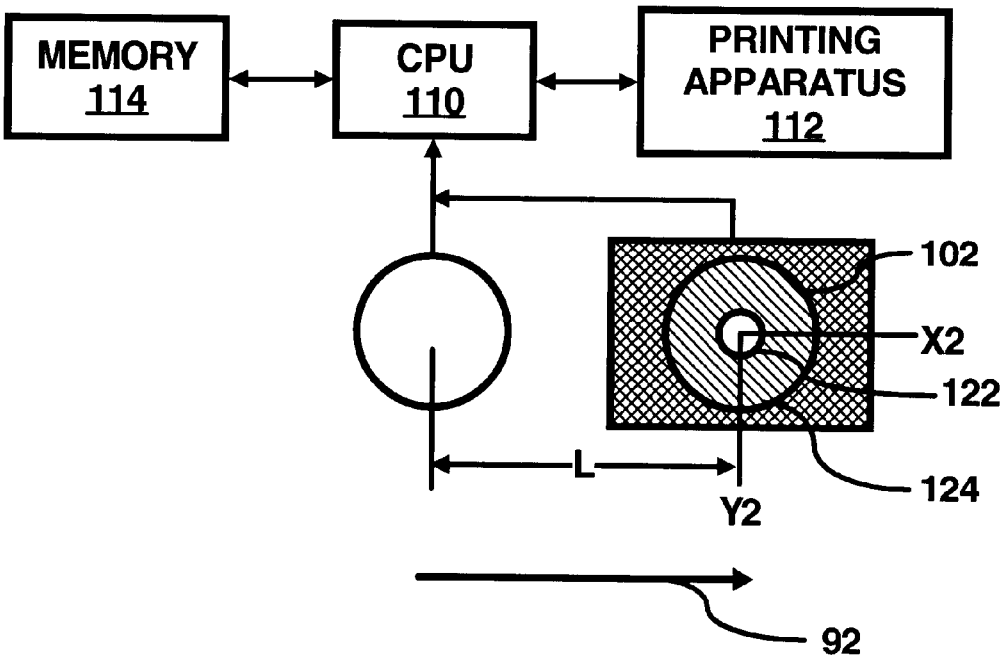

FIGS. 4A–4B, collectively, illustrate another manner of implementing the device of FIG. 1. This manner may be implemented to determine whether the print media, e.g., media 92, has expanded and/or contracted (e.g., a dimensional change in the media) during a printing operation. As FIGS. 4A and 4B are similar to FIGS. 3A and 3B described above, only those differences pertaining to this implementation will be discussed below.

With reference first to FIG. 4A, instead of applying a relatively small amount of printing material onto the print medium, a relatively large amount of printing material 120 is applied with a portion 122 thereof being substantially unprinted. The striped section 124 generally denotes the field of view of the first camera 82. In addition, as seen in FIG. 4B, when the media is advanced a distance L, the substantially unprinted portion 122 is within the field of view of the second camera 32. A similar calculation of the centroids (x1, x2, y1, y2) may be performed by the CPU 110 to determine whether the print media has undergone any contraction and/or expansion.

A determination of errors due to contraction and/or expansion described above with respect to FIGS. 4A and 4B may be implemented following a determination of media advance errors as described above with respect to FIGS. 3A and 3B. In this regard, the magnitude and direction of errors determined through implementation of the media advance error determination may be removed from the magnitude and direction of errors due to media contraction/expansion to generally isolate the errors due to media contraction/expansion.

Figure 5:
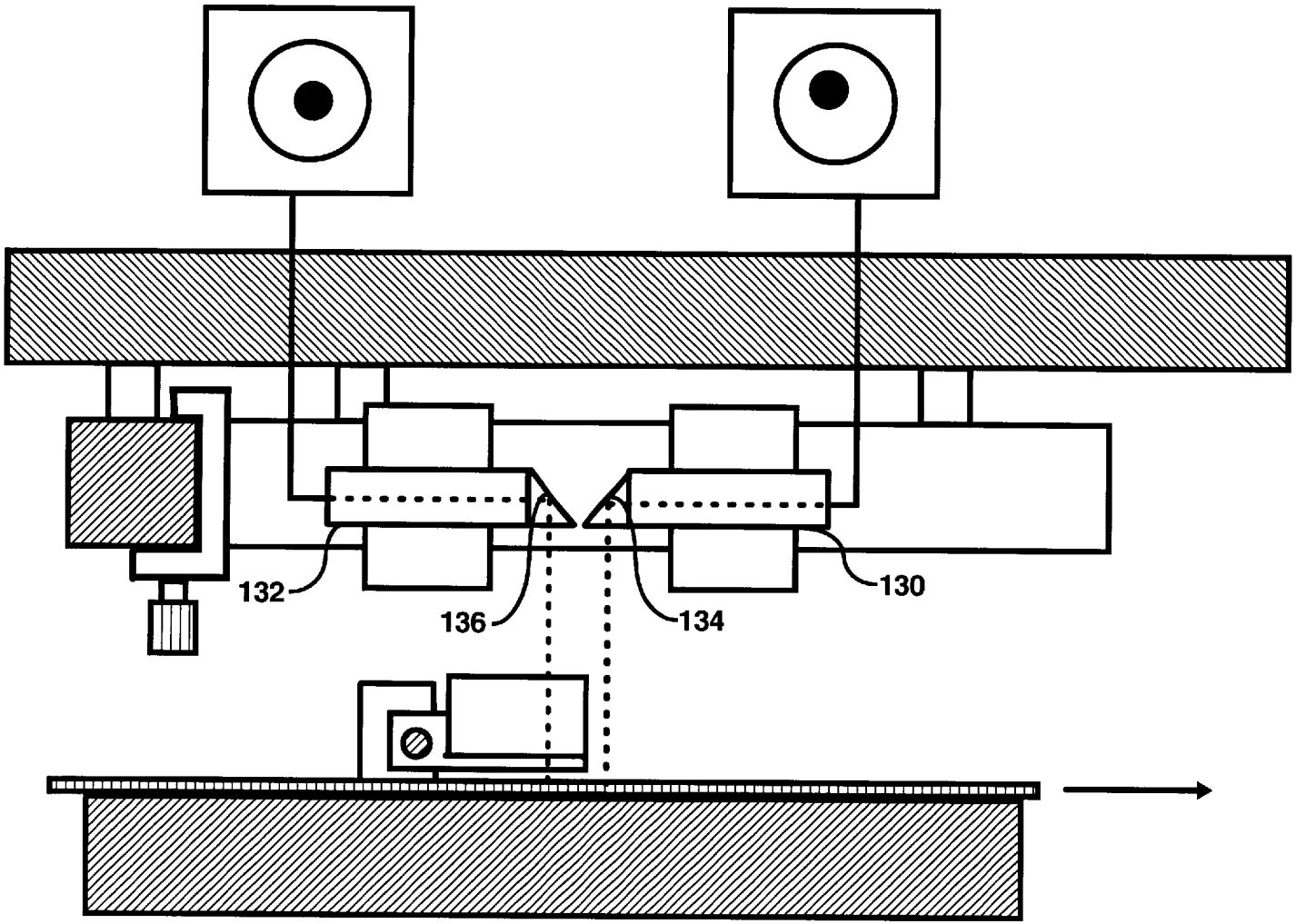
FIG. 5 shows a cross-sectional side view similar to FIG. 2 according to another arrangement of the invention.

FIG. 5 illustrates a cross-sectional side view similar to FIG. 2 according to another embodiment of the invention. As seen in FIG. 5, a pair of cameras 130 and 132 are positioned to photograph images of printed material on the media 92. The pair of cameras 130 and 132 are positioned substantially along the same plane and are facing one another. The light receiving ends of the cameras 130 and 132 are provided with respective reflective surfaces 134 and 136 which reflect light entering the cameras 130 and 132 substantially ninety degrees. The reflective surfaces 134 and 136 may comprise similar materials to those described hereinabove with respect to the reflective surfaces 34 and 84.

As may be seen in FIG. 5, the reflective surfaces 134 and 136 enable for the fields of view of the cameras 130 and 132 to be relatively close to one another. Therefore, this configuration also enables for substantially accurate determinations of media advance errors as well as media expansion and/or contraction in the same manner as previously described.

It should be understood that the configurations of the camera assemblies depicted in FIGS. 2 and 5 may be combined in a single device without departing from the scope of the invention. For example, various camera assembly configurations may be implemented along different mounting plates of a device. As another example, one mounting plate may comprise a camera assembly having the configuration depicted in FIG. 2 and a camera assembly having the configuration depicted in FIG. 5.

While the invention has been described with reference to certain exemplary embodiments thereof, those skilled in the art may make various modifications to the described embodiments of the invention without departing from the true spirit and scope of the invention. The terms and descriptions used herein are set forth by way of illustration only and not meant as limitations. In particular, although the present invention has been described by examples, a variety of other devices would practice the inventive concepts described herein. Although the invention has been described and disclosed in various terms and certain embodiments, the scope of the invention is not intended to be, nor should it be deemed to be, limited thereby and such other modifications or embodiments as may be suggested by the teachings herein are particularly reserved, especially as they fall within the breadth and scope of the claims here appended. Those skilled in the art will recognize that these and other variations are possible within the spirit and scope of the invention as defined in the following claims and their equivalents.

What is claimed is:

1. A method of imaging material, said method comprising:

photographing a section of a medium with a first camera having a first field of view;

advancing said medium along a feed direction;

photographing said section with a second camera having a second field of view, wherein at least one of said first field of view and said second field of view is shifted from a nominal location by one or more reflective surfaces;

comparing an actual advance of said medium with an intended advance of said medium; and determining whether at least one of a media advance error and a dimensional change in said media exists in response to said comparing step.

2. The method according to claim 1, wherein said step of comparing an actual advance of said medium with an intended advance of said medium comprises determining a first centroid of said section photographed by said first camera and a second centroid of said section photographed by said second camera and comparing the locations of said first and second centroids.

3. The method according to claim 1, wherein said step of advancing said medium comprises advancing said medium a distance relatively shorter than a swath height.

4. The method according to claim 3, wherein said distance is equal to a sub-pass of a multiple pass printing operation of a printing device.

5. The method according to claim 1, further comprising:

returning an indication that a media feed error exists in response to the actual advance of said medium not equaling said intended advance of said medium.

6. The method according to claim 1, wherein said section comprises a printed material.

7. The method according to claim 1, wherein said medium comprises a material that is substantially resistant to at least one of expansion and contraction to generally isolate said media advance error.

8. The method according to claim 1, further comprising:

applying printing material onto said medium in a predetermined configuration, said predetermined configuration having at least one portion having no printing material, wherein said section includes said at least one portion.

9. The method according to claim 8, wherein said step of applying printing material comprises applying printing material onto a medium that is substantially resistant to at least one of expansion and contraction to generally isolate said media advance error, said method further comprising:

calibrating said actual advance of said medium with said generally isolated media advance error;

applying printing material onto a second medium in a predetermined configuration; and generally isolating said dimensional change in said media according to said calibrated actual advance of said second medium.

10. The method according to claim 8, further comprising:

returning an indication that a dimensional change in said media exists in response to the actual advance of said medium not equaling said intended advance of said medium.

11. A system for imaging print media configured to advance along a feed direction, said system comprising:

a first camera assembly including a first camera having a first field of view and at least one reflecting surface configured to shift said first field of view from a nominal location;

a second camera assembly having a second camera; and a computer configured to receive images photographed by said first camera and said second camera, said computer also being configured to determine a vector indicating a distance traveled by a section of the print media photographed by the first camera and the second camera.

12. The system according to claim 11, wherein said at least one reflecting surface of said first camera assembly is configured to shift said first field of view toward said second field of view.

13. The system according to claim 12, wherein said computer is configured to determine a centroid of a printed element within said shifted first field of view and to determine a centroid of said printed element within said second field of view.

14. The system according to claim 12, wherein said first camera assembly is configured to be positioned at a location that enables the first field of view to be substantially directly over a portion of a print zone of a printing device.

15. The system according to claim 11, wherein said second camera assembly is configured to be positioned at a location that enables the second field of view to be downstream of said first field of view along said feed direction.

16. The system according to claim 11, wherein said computer is further configured to compare said vector with a predetermined intended advance of said print medium.

17. The system according to claim 16, wherein said computer is operable to determine a media advance error in response to said comparison between said vector and said predetermined intended advance of said print medium.

18. The system according to claim 11, further comprising a mounting plate, wherein said first camera assembly and said second camera assembly are positioned along said mounting plate and wherein said second camera assembly is further positioned generally downstream of said first camera assembly in a direction generally along said feed direction of said print medium.

19. The system according to claim 18, wherein said first camera assembly and said second camera assembly are slidably connected to said mounting plate.

20. The system according to claim 11, wherein said second camera includes a second field of view, and wherein said second camera assembly includes at least one reflecting surface configured to shift said second field of view from a nominal location.

21. The system according to claim 20, wherein said at least one reflecting surface of said first camera assembly and said at least one reflecting surface of said second camera assembly are configured to shift said first field of view and said second field of view toward one another.

22. An apparatus for determining errors during printing operations of a printing device, said printing device having a media feed direction, said apparatus comprising:

a first camera assembly having a camera with a first field of view and at least one reflective surface to deflect the first field of view from a nominal location;

a second camera assembly having a camera with a second field of view;

wherein said first camera and said second camera are configured to photograph a section of media contained in the printing device; and wherein said second camera assembly is positioned at a location substantially downstream of the first camera assembly along said media feed direction of the printing device.

23. The apparatus according to claim 22, wherein said at least one reflective surface of said first camera assembly comprises a pair of reflective surfaces positioned to shift the first field of view toward the second field of view.

24. The apparatus according to claim 22, wherein said second camera assembly includes at least one reflective surface to deflect the second field of view.

25. The apparatus according to claim 24, wherein said at least one reflective surface of said first camera assembly and said at least one reflective surface of said second camera assembly are configured to shift the fields of views of said first and second cameras toward one another.

26. The apparatus according to claim 22, wherein at least one of said first camera assembly and said second camera assembly is slidably positioned along a first mounting plate.

27. The apparatus according to claim 22, further comprising:

a third camera assembly having a camera with a third field of view and at least one reflective surface to deflect the third field of view from a nominal location; and a fourth camera assembly having a camera with a fourth field of view, and at least one reflective surface to deflect the fourth field of view from a nominal location, wherein said fourth camera assembly is positioned at a location substantially downstream of the third camera assembly along a media feed direction of the printing device.

28. The apparatus according to claim 27, wherein said third camera assembly and said fourth camera assembly are slidably positioned along a second mounting plate.

29. The apparatus according to claim 28, wherein said first camera assembly and said second camera assembly are slidably positioned along a first mounting plate, and wherein said first mounting plate and said second mounting plate are slidably connected to a track.

30. The apparatus according to claim 29, wherein said first mounting plate and said second mounting plate extend generally perpendicularly from said track in a direction generally along the media feed direction of the printing device.

31. The apparatus according to claim 22, wherein said at least one reflective surface of said first camera assembly and said second camera assembly comprises reflective surfaces positioned to respectively deflect the first and second fields of views substantially perpendicularly.

32. The apparatus according to claim 22, wherein the first camera assembly and second camera assembly are configured to produce images useable to measure an object to within about 5 microns ($5\times10^{-6}$ meters).

33. The apparatus according to claim 22, wherein said at least one reflective surface comprises one or more of prisms and mirrors.

34. An apparatus for imaging print media, said apparatus comprising:

first means for photographing a section of said print media, said first photographing means having a first field of view;

second means for photographing said section of said print media, said second means having a second field of view;

means for deflecting said first field of view from a nominal location toward said second nominal field of view; and means for determining whether at least one of a media advance error and a dimensional change in said media exists.

35. The apparatus according to claim 34, further comprising:

means for determining a first centroid of said element photographed by said first photographing means and a second centroid of said element photographed by said second photographing means.

36. The apparatus according to claim 34, further comprising:

means for slidably supporting at least one of said first photographing means and said second photographing means.

37. The apparatus according to claim 34, wherein said second photographing means comprises means for deflecting said second field of view from a nominal location toward said first field of view.

38. A computer readable storage medium on which is embedded one or more computer programs, said one or more computer programs implementing a method for imaging material, said one or more computer programs comprising a set of instructions for:

photographing a section of a medium with a first camera having a first field of view;

advancing said medium along a feed direction;

photographing said section with a second camera having a second field of view, wherein at least one of said first field of view and said second field of view is shifted from a nominal location by one or more reflective surfaces;

comparing an actual advance of said medium with an intended advance of said medium; and determining whether at least one of a media advance error and a dimensional change in said media exists in response to said comparing step.

39. The computer readable storage medium according to claim 38, said one or more computer programs further comprising a set of instructions for:

determining a first centroid of said section photographed by said first camera and a second centroid of said section photographed by said second camera and comparing the locations of said first and second centroids.

40. The computer readable storage medium according to claim 38, said one or more computer programs further comprising a set of instructions for:

applying printing material onto said medium in a predetermined configuration, said predetermined configuration having at least one portion having no printing material, wherein said section includes said at least one portion.

* * * * *

UNITED STATES PATENT AND TRADEMARK OFFICE

CERTIFICATE OF CORRECTION

PATENT NO. : 6,640,716 B1
DATED : November 4, 2003
INVENTOR(S) : Alonso et al.

It is certified that error appears in the above-identified patent and that said Letters Patent is hereby corrected as shown below:

Column 3,
Line 35, replace “when” with -- where --.

Column 6,
Lines 20 and 24, replace “10” with -- 110 --.

Signed and Sealed this

Sixth Day of April, 2004

JON W. DUDAS
*Acting Director of the United States Patent and Trademark Office*